US007343133B2

(12) United States Patent
Ueno

(10) Patent No.: US 7,343,133 B2
(45) Date of Patent: Mar. 11, 2008

(54) CLEANING BRUSH AND IMAGE FORMING APPARATUS

(75) Inventor: Takashi Ueno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/275,113

(22) Filed: Dec. 12, 2005

(65) Prior Publication Data

US 2006/0127147 A1 Jun. 15, 2006

(30) Foreign Application Priority Data

Dec. 15, 2004 (JP) ..... 2004-363345

(51) Int. Cl.
*G03G 21/00* (2006.01)

(52) U.S. Cl. ..... 399/353

(58) Field of Classification Search ..... 399/343, 399/352, 353; 15/256.5, 256.51, 256.52, 15/256.6

See application file for complete search history.

(56) References Cited

U.S. PATENT DOCUMENTS 7,212,779 B2 * 5/2007 Yanagizawa et al. ..... 399/353

FOREIGN PATENT DOCUMENTS

| | | | |
|---|---|---|---|
| JP | 58-144875 | | 8/1983 |
| JP | 2520078 | | 9/1996 |
| JP | 2003-271032 | * | 9/2003 |
| JP | 2006-195451 | * | 7/2006 |

OTHER PUBLICATIONS

Computer-Generated Translation of Japanese Registered Utility Model No. 2520078.

* cited by examiner

*Primary Examiner*—Hoan Tran
(74) *Attorney, Agent, or Firm*—Fitzpatrick, Cella, Harper & Scinto

(57) ABSTRACT

A cleaning brush can prevent "image deletion" and "toner filming" attributable to uneven wear, a streak, an injury, etc. on an image bearing member caused by endurance, and a streak on the image bearing member or the like surface-roughened for the purposes of a long life and a high quality of image. In an image forming apparatus provided with the cleaning brush for removing any untransferred toner residual on the image bearing member, that portion of the cleaning brush which is in contact with the image bearing member is constituted by at least two kinds of hairs having different thicknesses, and the deformation resistivity ρ of that portion of each hair which is in contact with the image bearing member is set to 1.15 N or greater.

5 Claims, 7 Drawing Sheets

CLEANING BRUSH AND IMAGE FORMING APPARATUS

BACKGROUND OF THE INVENTION

1. Field of the Invention

The invention relates to an image forming apparatus such as an analog or digital copying machine, a laser beam printer or a facsimile apparatus, irrespective of a single color or multi-color. Above all, it relates to the cleaning brush of cleaning means for removing a toner, paper dust, etc. adhering to an image bearing member, and an image forming apparatus provided with the same.

2. Related Background Art

There is known a method of causing a cleaning brush to abut against the upstream side of the distal end portion abutting position of a cleaning blade with respect to the movement direction of an image bearing member to thereby carry an untransferred toner (see Japanese Patent Application Laid-open No. S58-144875).

Also, there is known a method of uniformly wearing an image bearing member, and removing foreign substances or the like on this image bearing member (see Japanese Utility Model Registration No. 2520078).

However, even if in the aforedescribed construction, the cleaning brush is urged against the image bearing member, if a frictional contact force is not sufficient, a discharge product, etc. produced from a charger or the like adhere onto the image bearing member. Therefore, when the image forming apparatus is used first in the morning, there occurs a faulty image such as "image deletion" in which an image deleted, or "toner filming in which a toner or a component in the toner adheres onto the image bearing member. Also, as endurance progresses, uneven wear or a streak occurs to the surface of the image bearing member, or the discharge product, etc. piled in groove such as an injury or the toner or a component or the like in the toner adheres to the surface of the image bearing member, thereby causing the occurrence of a faulty image.

Further, in recent years, an image bearing member (a universal hardness value (HU) of 150 $N/mm^2$ or greater) having had its surface hardened and aiming at a long life is used in an image forming apparatus. Therefore, from the initial state of the image bearing member, the frictional force between the image bearing member and a cleaning blade is high and further, as endurance progresses, the frictional force between the image bearing member and the cleaning blade rises. Therefore, the turning-up or nicked edge of the blade, fluttering or the like occurs, and another faulty image occurs, such as the slipping of the toner through the nip of the cleaning blade.

So, as means for maintaining the long life of the image bearing member and yet, reducing the frictional force between the cleaning blade and the image bearing member, there is a method of forming a number of streaks in accordance with the circumferential direction of the image bearing member, and carrying out a surface roughening process on the surface of the image bearing member. Likewise in this case, adhering substances such as the discharge product or the like produced from a charger or the like, or the toner or a component or the like in the toner is piled in a groove formed by the surface roughening, and a streak-like faulty image corresponding to this groove occurs.

Further, when a surface-roughened image bearing member is used, the time until such a faulty image occurs become markedly shorter, as compared with an image bearing member having had its surface not roughened.

SUMMARY OF THE INVENTION

So, it is an object of the present invention to prevent the occurrence of "image deletion" and "toner filming" attributable to uneven wear, a streak, an injury, etc. on an image bearing member caused by endurance, and a streak on the image bearing member surface-roughened for the purposes of a long life and a high quality of image.

Also, it is an object of the present invention to provide a cleaning brush having at least two kinds of hairs having different thicknesses for contacting with the surface of an image bearing member and cleaning that surface, the thin hair being longer than the thick hair.

Further, it is an object of the present invention to provide an image forming apparatus having an image bearing member, and a cleaning brush for contacting with the surface of the image bearing member and removing any untransferred toner residual on the image bearing member, wherein the cleaning brush has at least two kinds of hairs having different thicknesses, the Vickers hardness of the image bearing member is 45 degrees or greater, and the thin hair is longer than the thick hair.

DESCRIPTION OF THE PREFERRED EMBODIMENTS

Some embodiments of the present invention will hereinafter be described with reference to the accompanying drawings.

First Embodiment

Figure 1:
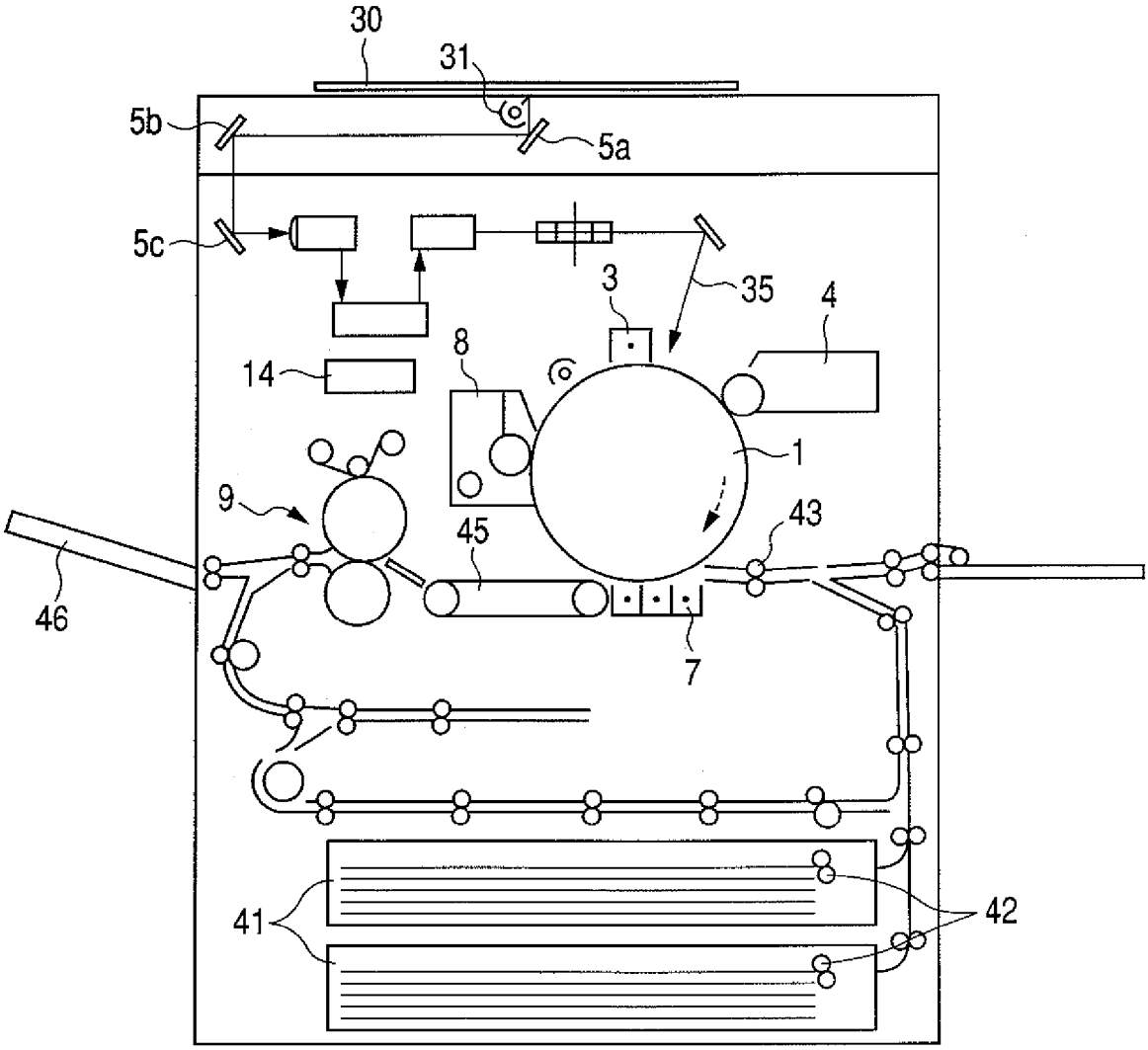
FIG. 1 is a cross-sectional view of an image forming apparatus according to the present invention.
Figure 2:
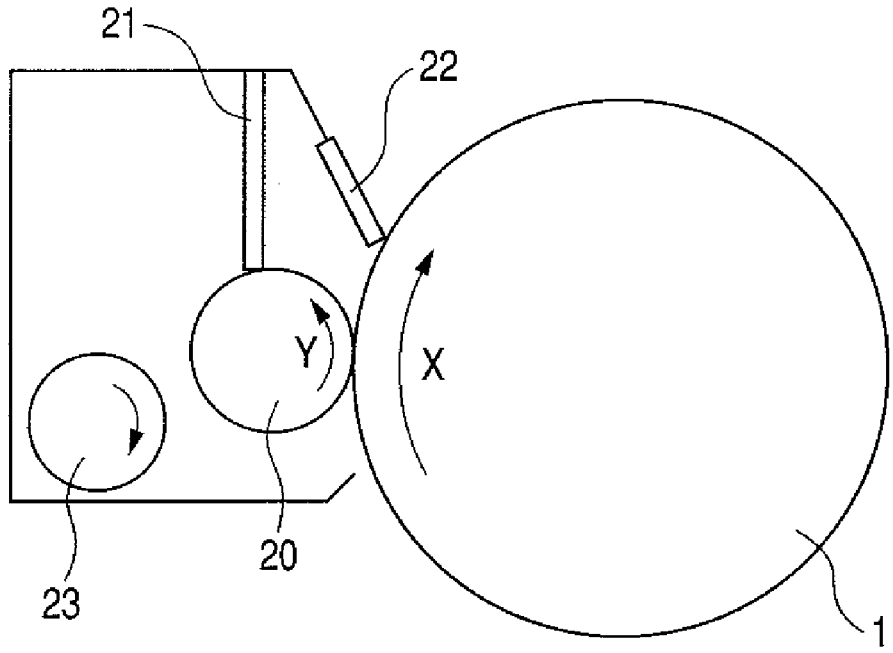
FIG. 2 is a cross-sectional view of a cleaning device of the image forming apparatus according to the present invention.
Figure 3:
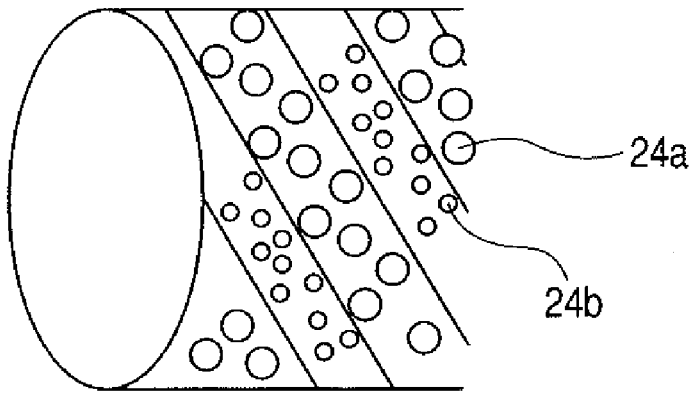
FIG. 3 is a fragmentary perspective view of a cleaning brush constituting the cleaning device of the image forming apparatus according to the present invention.
Figure 4:
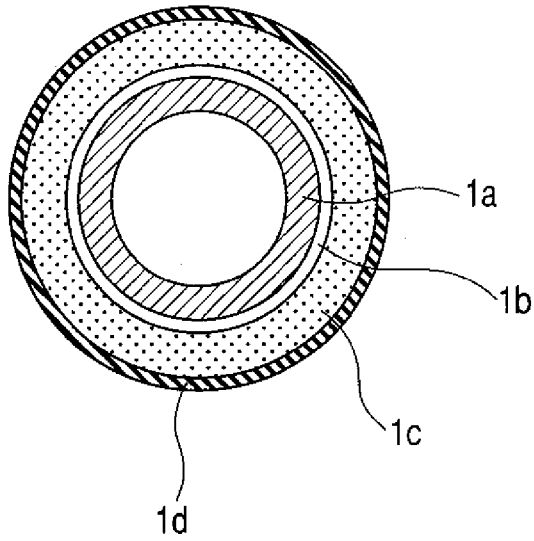
FIG. 4 is a transverse cross-sectional view of a photosensitive drum.

FIG. 1 is a cross-sectional view of an image forming apparatus according to the present invention, FIG. 2 is a schematic cross-sectional view of the cleaning device of the image forming apparatus, FIG. 3 is a fragmentary perspective view of the cleaning brush of the cleaning device, and FIG. 4 is a transverse cross-sectional view of an image bearing member.

In the upper portion of the main body of the image forming apparatus shown in FIG. 1, there is disposed an image reading mechanism for reading the image information of an original 30 as an information providing source.

That is, the reflected light of a light source 31 irradiating the original 30 placed on platen glass (not shown) with its image surface facing downward is reflected by mirrors 5*a*, 5*b* and 5*c*, and thereafter becomes a digital image signal image-modulated via an image reading element and a CPU for control.

Next, the digital image signal is applied as a laser beam 35 to the charging region of the outer peripheral surface of an image bearing member 1, whereby an electrostatic latent image is formed on the charging region.

The image bearing member 1 has its outer peripheral surface uniformly charged by a primary charger 3 disposed above the image bearing member 1, thereafter the laser beam 35 is applied to the image bearing member 1, whereby an electrostatic latent image is formed on the charging region of the outer peripheral surface of the image bearing member 1, and the electrostatic latent image is developed as a toner image with a toner which is the developer of a developing apparatus 4.

Next, the toner image formed on the outer peripheral surface of the image bearing member 1 is transferred to a recording medium P by a transfer charger 7, thereafter the recording medium P is separated from the outer peripheral surface of the image bearing member 1, and the recording medium P separated from the outer peripheral surface of the image bearing member 1 is conveyed to a fixing apparatus 9 by a conveying belt 45. The recording medium P conveyed to the fixing apparatus 9 is subjected to a fixing process by heat supply and pressure imparting from the fixing apparatus 9, and thereafter is discharged onto a sheet discharging tray 46.

The outer peripheral surface of the image bearing member 1 after the transferring process is subjected to cleaning such as the removal of a residue by a cleaning device 8, thereafter it is prepared for the next electrostatic latent image formation.

On the other hand, the recording medium P constituted by paper and synthetic resin or the like (in the present embodiment, the recording medium P will hereinafter be described as being constituted by paper) is conveyed as follows. The recording medium P is fed from a selected one of cassettes 41 detachably disposed in the lower portions of the image forming apparatus main body by a corresponding pair of sheet feeding rollers 42, thereafter it is conveyed from the pair of sheet feeding rollers 42 to a pair of registration rollers 43 disposed downstream with respect to the conveying direction of the recording medium.

The recording medium P conveyed to the pair of registration rollers 43 is conveyed to a transfer space formed between the image bearing member 1 and the transfer charger 7, in synchronism with the rotation of the image bearing member 1, and is subjected to a transferring process and a fixing process, and thereafter is discharged onto the sheet discharging tray 46.

The cleaning device 8 will now be described with reference to FIG. 2.

The cleaning device 8 is disposed adjacent to the image bearing member 1 rotatively driven in a direction (clockwise direction) indicated by the arrow X in FIG. 2. This cleaning device 8 has a cleaning brush 20 for frictionally contacting with the surface of the image bearing member 1 while being rotated in a direction (counter-clockwise direction) indicated by the arrow Y in FIG. 2 at a peripheral speed ratio 110% relative to the surface of the image bearing member 1, to thereby remove the toner and a foreign substance such as talc residual on the surface of the image bearing member 1. Also, there is provided a scraper 21 for contacting with the distal end of this cleaning brush 20 to thereby scrape off the toner, etc. adhering to the cleaning brush 20. There is also provided a cleaning blade 22 for frictionally contacting with the surface of the image bearing member 1 to thereby remove the toner and the foreign substance such as talc residual on the surface of the image bearing member 1. There is also provided a toner carrying screw 23 for carrying and collecting the toner, etc. removed from the surface of the image bearing member 1 by the cleaning brush 20 and the cleaning blade 22 into a waste toner containing portion (not shown).

The image bearing member 1 is constituted by a photosensitive drum having an outer diameter of ϕ84 mm. Generally, the photosensitive drum 1, as shown in FIG. 4, has a photosensitive layer applied onto an aluminum cylinder 1*a*, and the photosensitive layer is formed into two-layer structure comprising a charge generation layer 1*b* and a charge transport layer 1*c* thereon. In the photosensitive drum 1 in the present embodiment, a surface releasing layer 1*d* is further formed on the charge transport layer 1*c*. In the outermost surface layer of the photosensitive drum 1, fluorine resin particles (particle diameter of 0.3 μm) are usually dispersed with a view to reduce the frictional force against the cleaning blade 22.

Also, in the case of the photosensitive drum 1 directed to a long life and a high quality of image, there is a case where the content of the fluorine resin particles is decreased. By the content of the fluorine resin particles being decreased, the hardness of the photosensitive drum 1 is increased, and a long life and a high quality of image can be achieved, but the frictional force between the photosensitive drum 1 and the cleaning blade 22 becomes great.

Figure 5:
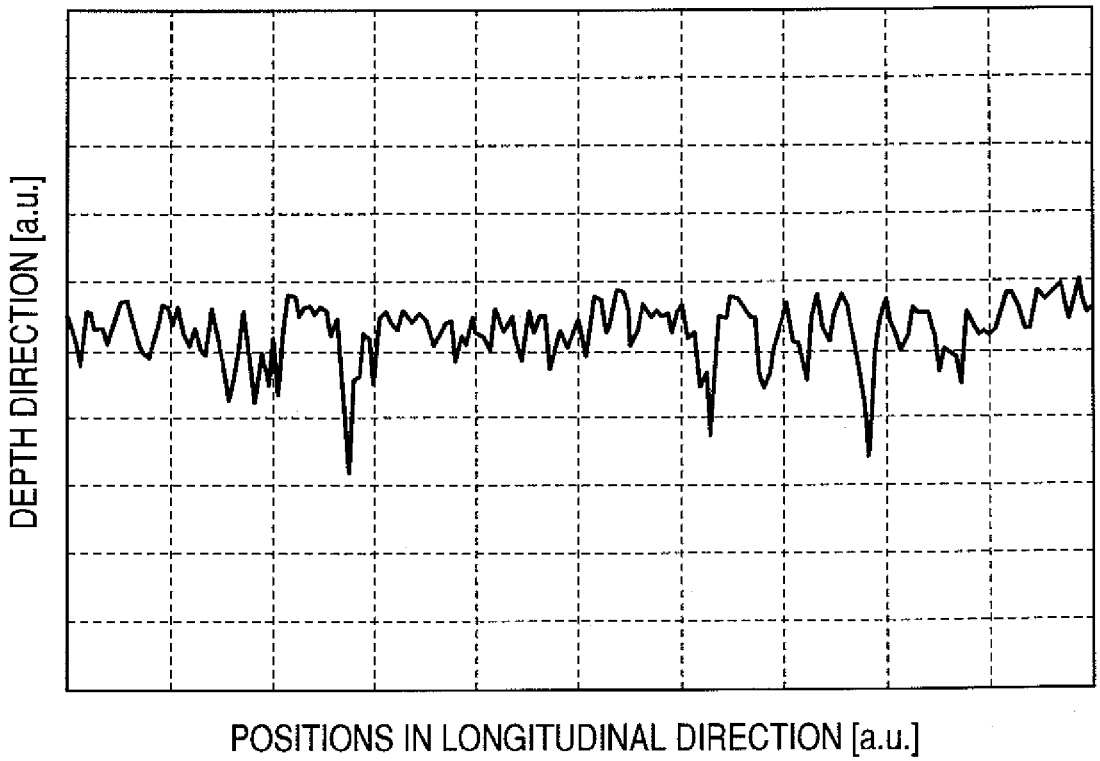
FIG. 5 shows a surface profile of the photosensitive drum.

Therefore, when the universal hardness value (HU) of the photosensitive drum 1 measured by applying a test load of 6 mN with using a Vickers square-based pyramidal diamond indenter is 150 $N/mm^2$ or greater, a number of streaks are formed in accordance with the circumferential direction of the surface of the photosensitive drum 1 in order to suppress the rise of the frictional force between the photosensitive drum 1 and the cleaning blade 22. That is, the surface of the photosensitive drum 1 was roughened on purpose to surface roughness Rz of 0.3 μm or greater. The surface profile of the photosensitive drum 1 at this time is shown in FIG. 5.

Here, the universal hardness value (HU) is a value obtained by dividing a load when an indentation was formed in a test surface by the use of a regular pyramidal indenter made of diamond, by the surface area of the indentation found from the length of the diagonal of a permanent, indentation left after the load was drawn out. In the present invention, the value was obtained by carrying out the measurement with a Vickers indenter mounted on FISCHER SCOPE (R) H100V produced by Fischer under the environment of a temperature of 25° C. and a humidity of 50%. For the indenter, a Vickers square-based pyramidal diamond indenter with a 136° angle between opposite faces may be used. Specifically, the measurements are carried out step-by-step up to the final test load of 6 mN (273 points, a holding time of 0.1 second for each point). In the present invention, the universal hardness value (hereinafter also referred to as HU) is calculated by the following equation on the basis of an indentation depth when displaced under the final test load of 6 mN.

$$HU = \frac{\text{test load [N]}}{\text{surface area of vickers indenter under the test load [mm}^2\text{]}} = \frac{F}{26.43h^2}$$

where h: indentation depth under test load [mm].

Also, the measurement of the surface roughness of the photosensitive drum was effected by the use of a surface roughness measuring machine SE3500 produced by Kosaka Research Institute, under the condition of Cutoff of 0.8 mm, a measurement length of 2.5 mm and a measurement speed of 0.1 mm/s.

In the present embodiment, an organic photosensitive member was used as the photosensitive drum 1, but if the universal hardness value (HU) is 150 N/mm$^2$ or greater, an inorganic photosensitive member of a-Si or the like can also be used.

The cleaning brush 20 will now be described with reference to FIG. 6.

Figure 6:
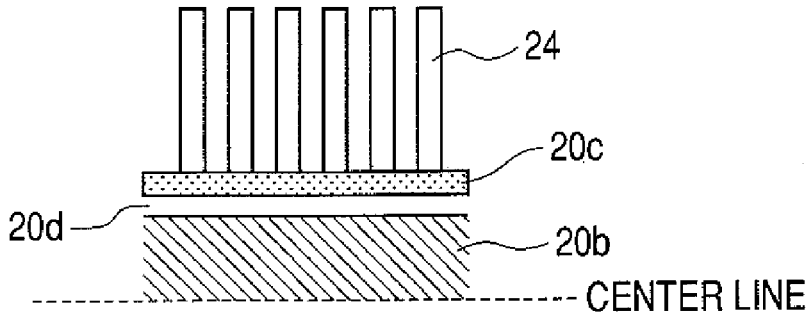
FIG. 6 is a cross-sectional view of the cleaning brush.

The cleaning brush 20, as shown in FIG. 6, is constituted by a rotary shaft 20*b*, cleaning brush hairs 24, and an adhesive agent layer 20*d* formed by implanting the cleaning brush hairs 24 into base cloth 20*c*, and adhesively securing the rotary shaft 20*b* and the base cloth 20*c* to each other. In the present embodiment, hairs having density of 50 kF and of which the distal ends are straight hairs are used as the cleaning brush hairs 24.

The cleaning brush 20 in the present invention will be further described with reference to FIGS. 3 and 7.

In the present embodiment, the thickness of thick hairs 24*a* shown in FIG. 3 is 6 D (denier), and the thickness of thin hairs 24*b* is 3 D.

The thick hairs 24*a* are hairs wide with respect to the rotation direction of the cleaning brush, and frictionally contact with the whole surface of the image bearing member. The thin hairs 24*b* are hairs narrow with respect to the rotation direction of the cleaning brush, and remove impurities piled in recesses in the surface of the image bearing member.

As the material of the hairs 24 of the cleaning brush 20, there is, an electrically conductive material such as, for example, stainless steel, or electrically conductive rayon. In the present embodiment, nylon is used. The single thread diameter at this time is, in calculation, about 30 μm for 6 D, and about 20 μm for 3 D. Regarding the thickness of the thin hairs 24*b*, the thinner they are the more effective they are to achieve the objects of the present invention.

However, the thinner they are, the lower becomes the deformation resistivity ρ of the hairs 24 of the cleaning brush 20 and correspondingly, the frictional contact force with the photosensitive drum 1 weakens. When the material of the hairs 24 of the cleaning brush 20 was nylon, the relation between the deformation resistivity ρ and thickness of the hairs 24 was 60 cN for 3 D, and 120 cN for 6 D.

Here, with a view to increase the frictional contact force of the cleaning brush with the image bearing member to thereby effectively effect the removal of the adhering substances, endurance was effected with the thickness of the hairs of the cleaning brush being 6 D (denier) or greater. The material of the hairs at this time is nylon. The deformability of the hair of the invention is defined as a value (hereinafter referred to as "deformation resistivity ρ") obtained by multiplying an apparent Young's modulus of the hair by a cross-section area (thickness) of the hair. The hair of the invention satisfies a relationship of: an apparent Young's modulus of the hair (cN/dtex)×a thickness of the hair (dtex)/100≧1.15 N. Herein, however, the following relationships are satisfied. 1 D (denier) represents a thickness of a thread having a weight of 1 g (gram) per a length of 9000 m. On the other hand, 1 denier substantially equals to 1 dtex (decitex). In the present application, it is assumed that 1 denier=1 decitex (dtex). Incidentally, the thickness of the hair is not significantly changed as a whole of a brush roller, but is a mean value of arbitrary extracted ten hairs.

However, as the endurance progressed, a streak-like faulty image occurred gradually. When use is made of a cleaning brush constituted by hairs having a thickness of 6 D or greater, this cleaning brush frictionally contacts with the whole surface of the image bearing member to thereby remove adhering substances such as a discharge product produced from the charger or the like and the toner or a component in the toner. However, because of the great thickness of the hairs, the tip ends of the hairs of the cleaning brush did not enter a groove formed by uneven wear, a streak, an injury or the like caused on the surface of the image bearing member by the endurance. Therefore, the adhering substances such as the discharge product produced from the charger or the like and the toner or the component in the toner were piled in this groove, thus causing the occurrence of a faulty image such as streak-like image deletion or toner filming corresponding to this groove.

Conversely, when use is made of a cleaning brush constituted by thin hairs having a thickness of 3 D or less, the deformation resistivity ρ of these hairs becomes lower correspondingly to the smaller thickness, and the frictional contact force with the image bearing member cannot be obtained sufficiently. The material of the hairs at this time was nylon, and the deformation resistivity ρ thereof was about 60 cN. Therefore, as the endurance progressed, a faulty image such as image deletion or toner filming occurred to the entire surface of the obtained image.

So, as a cleaning brush, use was made of one comprising nylon hair having a thickness of 6 D and nylon hairs having a thickness of 3 D, and equal in length and deformation resistivity ρ to each other, and wound in a spiral shape on a rotary shaft. In this case, the tip ends of the hairs having a thickness of 3 D or less do not enter a groove formed by endurance, and cannot remove adhering substances such as a discharge product and the toner or a component or the like in the toner piled in the groove. Therefore, there occurred a faulty image such as streak-like image deletion, toner filming, and etc. corresponding to the groove.

So, as a cleaning brush, use was made of one comprising nylon hair having a thickness of 6 D and nylon hairs having a thickness of 3 D, and equal in length and Young's modulus to each other, and wound in a spiral shape on a rotary shaft. In this case, the tip ends of the hairs having a thickness of 3 D or less do not enter a groove formed by endurance, and cannot remove adhering substances such as a discharge product and the toner or a component or the like in the toner piled in the groove. Therefore, there occurred a faulty image such as streak-like image deletion, toner filming, and etc. corresponding to the groove.

This is because the lengths of the two kinds of hairs are the same and therefore the hairs having a thickness of 6 D hinder the inroad of the hairs having a thickness of 3 D into the groove, and therefore, the effect of removing the adhering substances such as the discharge product and the toner or the component in the toner piled in the discharge-produced groove cannot be obtained.

Here, the relation between the construction of the cleaning brush and the image deletion is shown in Table 1 below.

TABLE 1

| | Relation between the Construction of the Cleaning Brush and the Image Deletion | | |
|---|---|---|---|
| | 3D | 6D | 3D and 6D |
| Faulty image level | Occurred on the whole surface | Occurred in a streak-like shape | Occurred in a streak-like shape |

From the result shown in Table 1, it can be seen that to obtain a sufficient frictional force with the photosensitive drum 1, the deformation resistivity ρ of the hairs 24 of the cleaning brush 20 must be 1.15 N or greater.

So, making the deformation resistivity ρ of the thin hairs 24*b* equal to 1.15 N can be achieved by changing the material of the hairs 24*b* to a material having a high apparent Young's modulus, or changing the content of carbon contained in the hairs 24*b* or the manner of dispersion of the carbon in the hairs 24*b* or the manner of dispersion of the carbon in the hairs 24*b*.

These two kinds of hairs 24*a* and 24*b* having different thicknesses are formed in a spiral form with respect to the rotary shaft 20*b*.

Figure 7A:
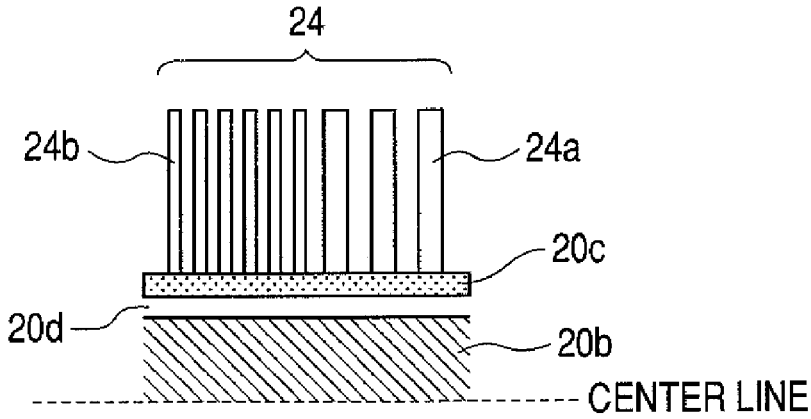
FIGS. 7A and 7B are schematic views of a cleaning brush according to a first embodiment of the present invention.
Figure 7B:
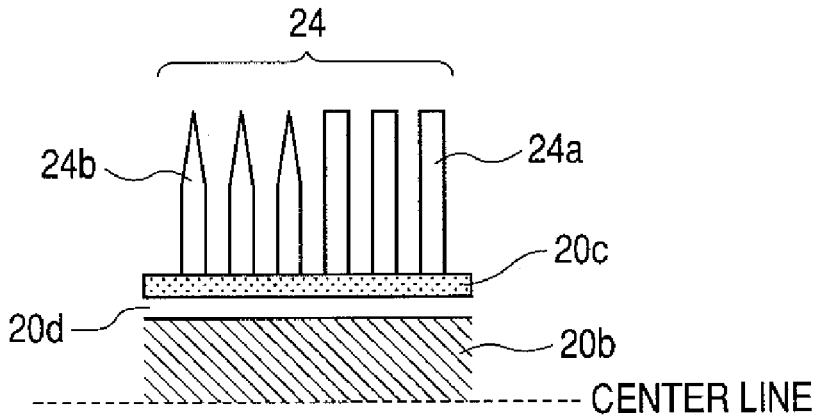

Also, regarding the thickness of the hairs 24 of the cleaning brush 20, a predetermined effect can be obtained by making the thickness of the entire hairs 24 different as shown in FIG. 7A. However, there is a case where the thin hairs 24*b* are torn to pieces by a scraper or the like abutting against the cleaning brush 20 and endurance is not kept. So, such hairs 24*a* and 24*b* as shown in FIG. 7B wherein only the portions thereof being in contact with the photosensitive drum 1 are formed with two kinds of different thicknesses are more desirable. Again in this case, it is desirable that the deformation resistivity ρ of those portions of the hairs 24 which are in contact with the photosensitive drum 1 be 1.15 N or greater for all of the hairs 24 of one cleaning brush 20.

Next, the result of a study using a surface-roughened photosensitive drum 1 having a profile shown in FIG. 5 is shown in Table 2 below. This has also supposed a streak or the like on the photosensitive drum 1 caused by endurance. This study was carried out with a cleaning brush 20 of nylon comprised of only hairs 24*a* having a thickness of 6 D. Further, the study was carried out with a cleaning brush 20 comprised of only hair 24*b* having a thickness of 3 D, and a cleaning brush 20 constituted by mixing hairs 24*b* having a thickness of 3 D and hairs 24*a* having a thickness of 6 D together and winding these hairs on a rotary shaft. The hairs 24 (24*a*, 24*b*) of these cleaning brushes 20 are of the same material and also have the same density.

As regards the cleaning brush 20 constituted by mixing the hairs 24*b* having a thickness of 3 D and the hairs 24*a* having a thickness of 6 D together and winding them, the following three kinds of cleaning brushes were prepared. A first one is a cleaning brush constituted by hairs of the same material having a thickness of 6 D and a thickness of 3 D, respectively, and having the same length of 5 mm. A second one is a cleaning brush constituted by hairs 24*b* and 24*a* having a thickness of 3 D and a thickness of 6 D, respectively, and having deformation resistivity ρ of 1.15 N or greater and the same length of 5 mm. A third one is a cleaning brush constituted by hairs 24*b* having a thickness of 3 D and hairs 24*a* having a thickness of 6 D, and having deformation resistivity ρ of 1.15 N or greater, the hairs 24*b* (length 7 mm) having a thickness of 3 D being long as compared with the hairs 24*a* (length 5 mm) having a thickness of 6 D.

As a method of making the deformation resistivity ρ of hairs equal to or greater than 1.15 N to thereby change the thickness thereof, there is a method of changing the content of carbon contained in the hairs 24 or the manner of dispersion of carbon therein.

These cleaning brushes 20 were carried on the cleaner of an idle rotating machine with the inroad amount thereof relative to the photosensitive drum 1 set to 0.7 mm, and were idly rotated for 5 hours and for 10 hours, respectively. As the idle rotating machine, use was made of a corona charger for both of primary charging and transfer. After they were idly rotated for 5 fours and for 10 hours, respectively, an image output was effected after they were left unused for one night, whereby the faulty image level was judged.

TABLE 2

| | Relation between the Construction of the Cleaning Brush and the Faulty Image | | | | |
|---|---|---|---|---|---|
| | 3D | 6D | 3D and 6D (the same material) | 3D and 6D (the same deformation resistivity ρ the same length) | 3D and 6D (the same deformation resistivity ρ the same length) |
| Faulty image level after 5 hours | x (whole surface) | x (streak) | Δ (streak) | Δ (streak) | ○ |
| Faulty image level after 10 hours | x (whole surface) | x (streak) | x (streak) | x (streak) | ○ |

As shown in Table 2, when the thickness of the hair 24 of the cleaning brush 20 was 3 D, the frictional contact force with the photosensitive drum 1 was not obtained and the discharge product adhering onto the surface of the photosensitive drum 1 could not be removed and therefore, the image after the cleaning brush was left unused for one night caused the occurrence of an image faulty over the whole surface thereof. This phenomenon becomes more remarkable as the thickness of the hairs 24 of the cleaning brush 20 is made smaller, because in such case, the deformation resistivity ρ is more lowered and the frictional contact force with the photosensitive drum 1 is more lowered. Also, when the thickness of the hairs 24 of the cleaning brush 20 is 6 D, the frictional contact force with the photosensitive drum 1 is great.

However, the hair 24 did not enter such a groove on the photosensitive drum 1 as shown in FIG. 4, but the discharge product was accumulated only in the groove portion, and the image after the cleaning brush was left unused for one night became like a streak. This phenomenon becomes more remarkable as the thickness of the hairs 24 of the cleaning brush 20 is made greater.

Lastly, description will be made of a case where hairs 24 of different thicknesses were wound in a spiral shape with respect to one cleaning brush 20.

In the case of a cleaning brush constituted by hairs of the same material having a thickness of 6 D and a thickness of 3 D, respectively, and equal in length to each other, the hairs 24*a* having the thickness of 6 D frictionally contact with the whole of the photosensitive drum 1 to thereby remove almost all of the discharge product, etc. adhering to the photosensitive drum 1. Further, the tip ends of the hairs 24*b* having the thickness of 3 D enter the groove the tip ends of the hairs 24*a* having the thickness of 6 D cannot enter, whereby the discharge product, etc. accumulated in the groove are removed. Thereby, the image after the cleaning brush was left unused for one night after it was idly rotated for 5 hours did not cause the occurrence of image deletion on the whole surface thereof, and there was obtained an image somewhat like a streak.

This is because in the case of the same material, the deformation resistivity ρ of the thin hairs 24*b* is low and therefore, not so much frictional contact force with the photosensitive drum 1 is obtained and the discharge product, etc. are gradually piled in the groove on the surface of the photosensitive drum 1. Therefore, as shown in Table 2, the image after 5 hours of idle rotation becomes somewhat like a streak and further, the image after 10 hours of idle rotation caused the occurrence of a faulty image clearly in the shape of a streak. This is a phenomenon, which is more remarkable as the thickness of the hairs 24 becomes smaller.

Also, when use is made of only thin hairs of which the deformation resistivity ρ was simply made high and the frictional contact force with the photosensitive drum is small, thus causing the occurrence of unevenness or an injury. When in order to prevent this, the density of the hairs of the brush is increased to thereby increase the area of contact, clogging by the residual toner among fibers occurs and the cleaning brush comes to have no cleaning function.

On the other hand, in the case of a cleaning brush constituted by hairs having a deformation resistivity ρ of 1.15 N or greater and equal in length to each other, in a cleaning brush 20 constituted by hairs 24 (24*a*, 24*b*) of 3 D and 6 D having a deformation resistivity ρ of 1.15 N or greater, the thin hairs 24*b* are equal in deformation resistivity ρ to the thick hairs 24*a*. There is obtained a frictional contact force sufficient to refresh the surface of the photosensitive drum 1, but the lengths of the two kinds of hairs are the same and therefore, the hairs having a thickness of 6 D hinder the inroad of the hairs having a thickness of 3 D into the groove, and the thin hairs do not enter the inner part of the groove. Therefore, the tip ends of the hairs having a thickness of 3 D or less did not come into the groove formed by endurance, and the discharge produce, etc. piled in the groove and the adhering substance such as the toner or a component in the toner could be removed, thus resulting in the occurrence of a faulty image such as streak-like image deletion or toner filming corresponding to the groove.

Further, in the case of a cleaning brush in which the deformation resistivity ρ of all hairs is 1.15 N or greater and the hairs having a thickness of 3 D are long as compared with the hairs having a thickness of 6 D, the following result was obtained. That is, the thin hairs 24*b* is equal in deformation resistivity ρ to the thick hairs 24*a*, and there is obtained a frictional contact force sufficient to refresh the surface of the photosensitive drum 1, and the hairs having the thickness of 3 D are long as compared with the hairs having the thickness of 6 D and therefore, the inroad of the hairs having the thickness of 3 D into the groove and therefore, the image after idle rotation was effected for 10 hours did not cause the occurrence of image deletion on the entire surface thereof and further, there was obtained an image, which was not like a streak.

While in the foregoing, description has been made of a cleaning brush constituted by two kinds of hairs having different thicknesses, an effect similar to that described above can also be obtained in the case of more than two kinds of hairs. This also holds true of a case where at least two kinds of different hairs are implanted in discrete cleaning brushes.

Second Embodiment

Second Embodiment will now be described. Second Embodiment is similar to first Embodiment unless particularly specified, and similar members are given the same reference characters and need not be described.

In the present embodiment, a case where the material of the hairs of the cleaning brush and the content and manner of dispersion of carbon are not changed, and the deformation resistivity ρ of both of the thin hairs and the thick hairs are 1.15 N or greater will be described with reference to FIGS. 8A and 8B.

The basic constructions of the apparatus, the cleaning brush 20, etc. used in the present embodiment are similar to those shown in first Embodiment.

Figure 8A:
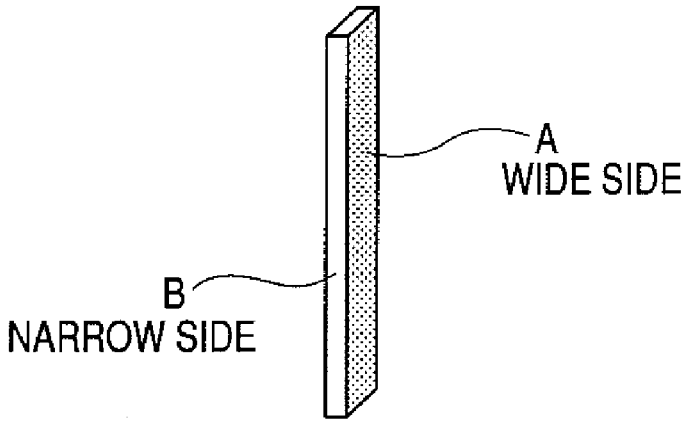
FIGS. 8A and 8B are schematic views of a cleaning brush according to a second embodiment of the present invention.

FIG. 8A shows the hair of the cleaning brush used in the present embodiment. This hair is a flat hair provided with a wide surface A and a narrow surface B and having deformation resistivity ρ of 1.15 N or greater. Also, the width of the hair on the side A is 30 μm or greater, and the width of the hair on the side B is 20 μm or less, and in terms of the thicknesses of the hairs in first Embodiment, the side A corresponds to 6 D or greater and the side B corresponds to 3 D or less. As shown in FIG. 8B, these hairs were implanted in basic cloth 20*c*, and were wound in a spiral shape with respect to the rotary shaft 20*b* to thereby obtain an effect equal to that of the first Embodiment.

This has a function equal to that of the thick hairs in first Embodiment by adjusting the wide side A of the hair to the rotation direction of the cleaning brush 20. This is because the narrow side B of the hair is adjusted to the rotation direction of the cleaning brush 20 to thereby have a function equal to that of the thin hairs in the first Embodiment.

In the present embodiment, the hair narrow with respect to the rotation direction is made longer than the wide hair.

Therefore, hairs 25*a* remove the discharge product, etc. on the whole surface of the photosensitive drum 1, and the tip ends of hairs 25*b* come into the groove on the surface of the photosensitive drum 1 to thereby remove the discharge product, etc. accumulated in the groove.

Also, it is unnecessary to discretely prepare hairs of different thicknesses and therefore, it is possible to suppress the cost.

Figure 8B:
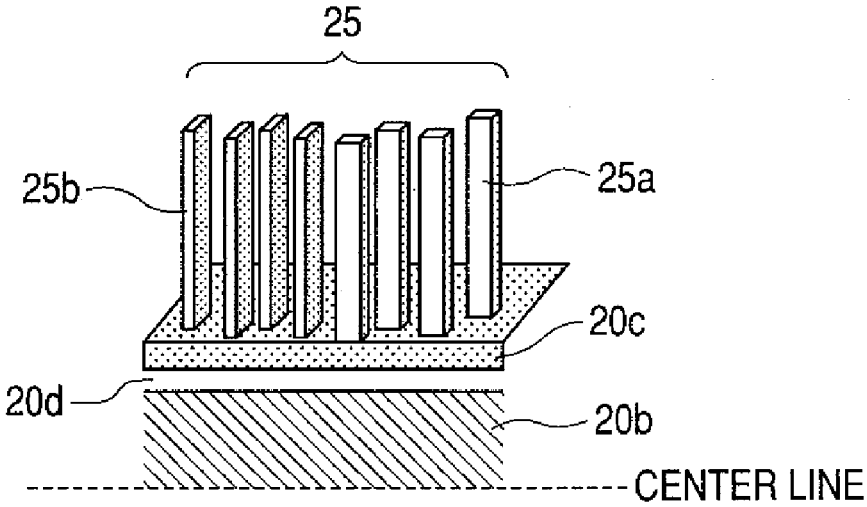

In FIG. 8B, the number of the hairs 25 of the cleaning brush is shown as a considerably small number, but this is for the convenience of illustration, and actually the cleaning brush is constituted by a number of hairs 25.

While in the present embodiment, description has been made of one cleaning brush 20 constituted by two kinds of different shapes, an effect similar to that described previously can also be obtained in a case where the hairs of at least two kinds of different cleaning brushes are implanted in discrete cleaning brushes.

Third Embodiment

Third Embodiment will now be described.

Third Embodiment is similar to the first Embodiment unless particularly specified, and similar members are given the same reference characters and need not be described.

In the present embodiment, the tip end of the hair of the cleaning brush 20 is loop-shaped, and in that portion of the loop which is in contact with the photosensitive drum, the shaft side of the loop faces in the rotation direction of this cleaning brush 20. (Here, the shaft side of the loop refers to a side on which this side on which the hair is turned back and the inner part side are to overlap each other when the hair forming the loop is viewed. On the other hand, a side on which a face formed by the hair being looped is seen is referred to as the surface side of the loop.) In other words, the hair is implanted in the base cloth 20*c* so that a surface formed by hairs 26 being looped may be substantially parallel to the rotation direction of the cleaning brush 20. Further, in the present embodiment, a case where the cleaning brush is constituted by two or more kinds of hairs having different thicknesses and the deformation resistivity ρ of all the portions of the hairs constituting this single cleaning brush 20 which are in contact with the photosensitive drum 1 are 1.15 N or greater will hereinafter be described with reference to FIGS. 9A and 9B.

The basic constructions of the apparatus, the cleaning brush 20, etc. used in the present embodiment are similar to those shown in the first Embodiment.

Figure 9A:
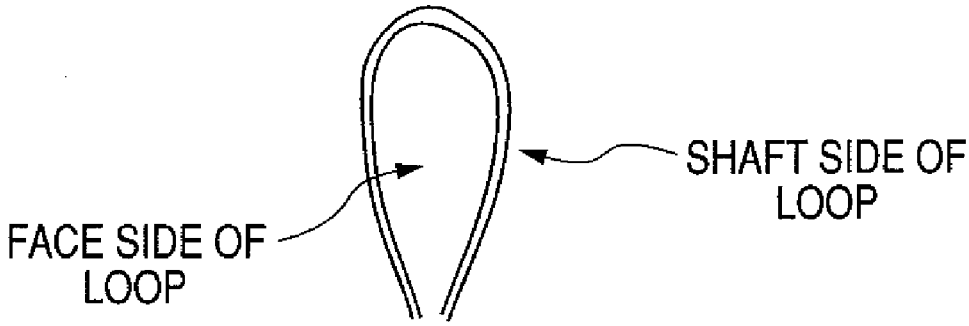
FIGS. 9A and 9B are schematic views of a cleaning brush according to a third embodiment of the present invention.

FIG. 9A shows the hair of the cleaning brush used in the present embodiment.

Figure 9B:
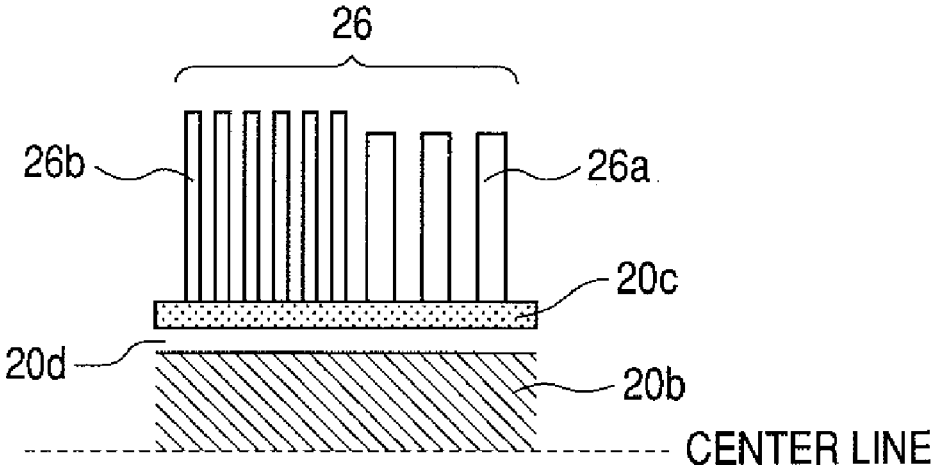

This hair 26 has its tip end formed into a loop shape, and the deformation resistivity ρ thereof is 1.15 N or greater. As shown in FIG. 9B, these hairs 26 are implanted in the base cloth 20*c* with the shaft side of the loop of the tip end of the hair facing in the rotation direction of the cleaning brush 20. (The hairs 26 are implanted in the base cloth 20*c* so that the faces formed by the hairs 26 being looped are substantially parallel to the rotation direction of the cleaning brush 20.) By doing so, the hairs were wound in a spiral shape with respect to the rotary shaft 20*b* to thereby obtain an effect similar to that of the first Embodiment.

This is because the shaft side of the loop faces in the rotation direction of the cleaning brush 20, whereby the tip ends of the hairs 26 can be considered in the same way as in the case of straight hairs.

In the present embodiment, the hairs are implanted so that the loops formed by thin hairs may be longer than the loops formed by thick hairs. That is, the thin hair is great in the length thereof with respect to the diametral direction of the cleaning brush 20, as compared with the thick hairs.

While in the present embodiment, description has been made of a cleaning brush constituted by two kinds of hairs having different thicknesses, a similar effect can also be obtained in the case of more than two kinds of hairs. This also holds true of a case where the hairs of at least two kinds of different cleaning brushes are implanted in discrete cleaning brushes.

Fourth Embodiment

Fourth Embodiment will now be described.

In the present embodiment, a cleaning brush of a construction in which the tip end of hair is loop-shaped and in that portion of the hair which is in contact with the photosensitive drum, the shaft side and face side of the loop face in the rotation direction of the cleaning brush will hereinafter be described with reference to FIGS. 10A and 10B.

The basic constructions of the apparatus and the cleaning brush 20 used in the present embodiment are similar to those shown in the first Embodiment.

Figure 10A:
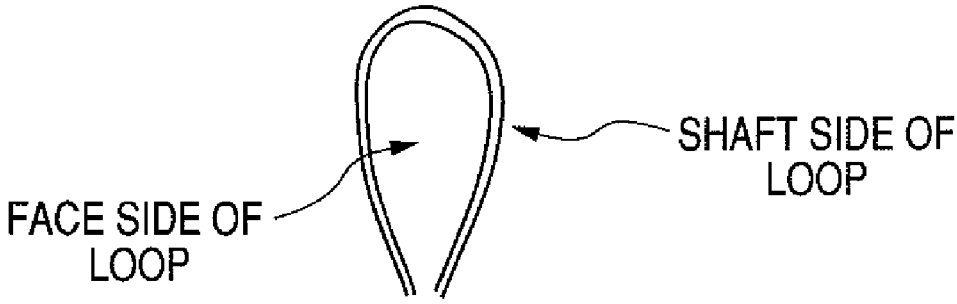
FIGS. 10A and 10B are schematic views of a cleaning brush according to a fourth embodiment of the present invention.
Figure 10B:
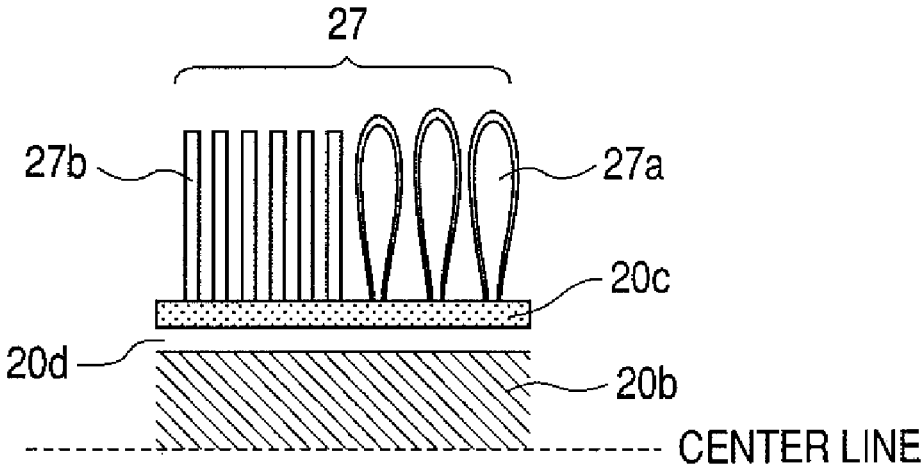

FIG. 10A shows the hair of the cleaning brush used in the present embodiment.

This hair 27 has its tip end formed into a loop shape, and the deformation resistivity ρ thereof is 1.15 N or greater. As shown in FIG. 10B, these hairs 27 are implanted in the base cloth 20*c* so that the shaft side and face side of the loops of the tip ends of the hairs may face in the rotation direction of the cleaning brush 20, and are wound in a spiral shape around the rotary shaft 20*b*. (The hairs 27 are implanted so that the faces thereof formed by being looped may be parallel and perpendicular to the rotation direction.) By doing so, an effect similar to that of the first Embodiment was obtained.

This is because hair 27*b* of which the shaft side of the loops faces in the rotation direction of the cleaning direction (which are implanted with the faces thereof formed by being looped-being parallel to the rotation direction) have the function of the thick hairs in the first Embodiment. In the present embodiment, the hairs 27 are implanted so that the hairs 27*a* perpendicular to the rotation direction of the cleaning brush 20 may be greater in the length of the brush than the hairs 27*b* parallel to the rotation direction of the cleaning brush 20.

Therefore, hairs 27*a* remove the discharge product, etc. on the whole surface of the photosensitive drum 1, and the tip ends of hairs 27*b* come into the groove on the surface of the photosensitive drum 1 to thereby remove the discharge product, etc. accumulated in the groove.

While in the present embodiment, description has been made of a cleaning brush constituted by two kinds of hairs having different directions of loops, an effect similar to that described above can also be obtained in the case of more than two kinds of different directions of loop. This also holds true of a case where the hairs of at least two kinds of different cleaning brushes are implanted in discrete cleaning brushes.

Also, while in the foregoing embodiments, a case when a cleaning brush is applied to an image forming apparatus has been described as an example, this is not restrictive if within the technical idea of the present invention. For example, the present invention can also be applied to a detachably mountable process unit or the like having an image bearing member and a cleaning device having at least a clearing brush.

This application claims priority from Japanese Patent Application No. 2004-363345 filed on Dec. 15, 2004, which is hereby incorporated by reference herein.

What is claimed is:

1. A cleaning brush comprising:

at least two kinds of hairs having different thicknesses, the hairs contacting with a surface of an image bearing member to clean the surface, a length of a thin hair of said hairs being longer than that of a thick hair of said hairs.

2. A cleaning brush according to claim 1, wherein said at least two kinds of hairs having different thicknesses are constituted by a hair having a thickness of 3 D or less, and a hair having a thickness of 6 D or greater.

3. A cleaning brush according to claim 1, wherein each of said hairs is formed in a spiral shape with respect to a rotary shaft.

4. An image forming apparatus comprising:

an image bearing member; and a cleaning brush, which contacts with a surface of said image bearing member to remove an untransferred toner residual on said image bearing member, said cleaning brush having at least two kinds of hairs having different thicknesses, wherein a universal hardness value (HU) of said image bearing member measured by applying a test load of 6 mN with using a Vickers square-based pyramidal diamond indenter is 150 $N/mm^2$ or greater.

5. An image forming apparatus according to claim 4, wherein a surface roughening process is carried out so that a surface roughness Rz of said image bearing member is 0.3 μm or greater.

* * * * *

UNITED STATES PATENT AND TRADEMARK OFFICE

CERTIFICATE OF CORRECTION

PATENT NO. : 7,343,133 B2
APPLICATION NO. : 11/275113
DATED : March 11, 2008
INVENTOR(S) : Takashi Ueno It is certified that error appears in the above-identified patent and that said Letters Patent is hereby corrected as shown below:

COLUMN 1:

Line 28, “adhere” should read --adheres--.
Line 32, ““toner filming” should read --“toner filming”--.
Line 65, “become” should read --becomes--.

COLUMN 4:

Line 54, “permanent,” should read --permanent--.

COLUMN 5:

Line 45, “is,” should read --is--.

COLUMN 6:

Line 12, “arbitrary” should read --arbitrarily--.
Line 41, “hair” should read --hairs--.
Lines 51-61, Lines 51 through 61 should be deleted.

COLUMN 7:

Line 24, Line 24 should be deleted.

COLUMN 8:

Line 17, “5 fours” should read --5 hours--.

COLUMN 9:

Line 22, “phenomenon,” should read --phenomenon--.
Line 45, “produce,” should read --product,--.
Line 54, “is equal” should read --are equal--.
Line 60, “groove and” should read --groove becomes easy. That is, the hairs having the thickness of 3 D enter the inner part of the groove and--.

UNITED STATES PATENT AND TRADEMARK OFFICE

CERTIFICATE OF CORRECTION

PATENT NO. : 7,343,133 B2
APPLICATION NO. : 11/275113
DATED : March 11, 2008
INVENTOR(S) : Takashi Ueno It is certified that error appears in the above-identified patent and that said Letters Patent is hereby corrected as shown below:

COLUMN 12:

Line 31, "clearing" should read --cleaning--.

Signed and Sealed this

Eleventh Day of November, 2008

JON W. DUDAS
*Director of the United States Patent and Trademark Office*